US009728367B2

(12) United States Patent
Park et al.

(10) Patent No.: US 9,728,367 B2
(45) Date of Patent: Aug. 8, 2017

(54) DIGITAL X-RAY SOURCE

(71) Applicant: UNIVERSITY-INDUSTRY COOPERATION GROUP OF KYUNG HEE UNIVERSITY, Yongin-si (KR)

(72) Inventors: Hun Kuk Park, Seoul (KR); Je Hwang Ryu, Seoul (KR)

(73) Assignee: UNIVERSITY-INDUSTRY COOPERATION GROUP OF KYUNG HEE UNIVERSITY, Yongin-Sin (KR)

( * ) Notice: Subject to any disclaimer, the term of this patent is extended or adjusted under 35 U.S.C. 154(b) by 269 days.

(21) Appl. No.: 14/417,546

(22) PCT Filed: Jul. 12, 2013

(86) PCT No.: PCT/KR2013/006253
§ 371 (c)(1),
(2) Date: Jul. 27, 2015

(87) PCT Pub. No.: WO2014/017766
PCT Pub. Date: Jan. 30, 2014

(65) Prior Publication Data

US 2015/0332887 A1 Nov. 19, 2015

(30) Foreign Application Priority Data

Jul. 27, 2012 (KR) ..... 10-2012-0082710

(51) Int. Cl.

| | |
|---|---|
| ***H01J 35/06*** | (2006.01) |
| ***H05G 1/52*** | (2006.01) |
| ***H01J 35/04*** | (2006.01) |

(52) U.S. Cl.
CPC ..... *H01J 35/06* (2013.01); *H01J 35/04* (2013.01); *H01J 35/065* (2013.01); *H05G 1/52* (2013.01);
(Continued)

(58) Field of Classification Search
CPC .. H01J 35/14; H01J 35/16; H01J 35/30; H01J 2235/087; H01J 35/065; H01J 1/304; H01J 2235/06; H01J 2235/1204; H01J 2235/062
See application file for complete search history.

(56) References Cited

U.S. PATENT DOCUMENTS

2005/0127351 A1 6/2005 Tolt
2009/0185660 A1 7/2009 Zou et al.
(Continued)

FOREIGN PATENT DOCUMENTS

FR 887331 A 11/1943
JP 2009245727 A 10/2009
(Continued)

OTHER PUBLICATIONS

Extended European Search Report for EP13823515.5 dated Mar. 11, 2016, 9 pages.
(Continued)

*Primary Examiner* — Hoon Song
(74) *Attorney, Agent, or Firm* — Lei Guo; Abel Law Goup, LLP

(57) ABSTRACT

The present invention discloses a digital X-ray source. The digital X-ray source includes an X-ray generation unit that emits X-rays, wherein the X-ray generation unit includes a cathode electrode; an emitter formed above the cathode electrode; an anode electrode located above the emitter; a gate electrode located between the emitter and the anode electrode; first and second focusing electrodes located
(Continued)

between the emitter and the anode electrode; and an electrode connecting unit configured to include one or more insulating tubes capable of fixing and adjusting the locations of the gate electrode and the first and second focusing electrodes on the cathode electrode, and also configured to individually insulate and connect the cathode electrode, the gate electrode and the first and second focusing electrodes from and with electric lines

9 Claims, 4 Drawing Sheets

(52) U.S. Cl.
CPC ..... *H01J 2201/30469* (2013.01); *H01J 2235/062* (2013.01)

(56) References Cited

U.S. PATENT DOCUMENTS

2011/0142204 A1 6/2011 Zou et al.
2012/0148027 A1 6/2012 Jeong et al.
2013/0022173 A1* 1/2013 Jeong ..... H01J 35/04 378/122

FOREIGN PATENT DOCUMENTS

KR 1020010042510 A 5/2001
KR 1020070099734 A 10/2007
KR 100819446 B1 4/2008
KR 1020080103286 A 11/2008
KR 101070091 B1 10/2011

OTHER PUBLICATIONS

Sagawa, 2001 SID International Symposium—Jun. 3-8, 2001, San Jose Convention Center, California, vol. XXXII, Jun. 3, 2001, p. 193, XP007007643.

* cited by examiner

DIGITAL X-RAY SOURCE

TECHNICAL FIELD

The present invention relates to an X-ray source, and more particularly to a field emission-type digital X-ray source that uses nano-material having a high resolution in units of micrometers or less, which is capable of improving the performance of detecting micro-tissue from among soft tissues having similar densities while controlling radiation dosage.

BACKGROUND ART

In general, in medical research, it is very important to acquire local, biological information in a target sample in order to investigate cell-substrate correlations.

The observation of human tissues using a radiological approach has conferred a great benefit to human civilization thanks to its advantages, such as noninvasiveness. In the fields of biotechnology and medical science, the radiological observation of micrometer-sized tissues has highly contributed to numerous research and development activities, making significant improvements toward human welfare.

However, since currently there is no effective method for correlating micro- or nano-sized structure information with biological information, there is a need for the appropriate combination of technologies and experiences for the development of new imaging technology as the way forward for the future.

With regard to this, conventional radiation apparatuses have millimeter-level resolution but cannot observe minute (micrometer-sized) tissues due to lack of spatial resolution, and thus there is a limitation in that such tissues must be observed by utilizing massive radiation using a particle accelerator.

Such a particle accelerator has a spatial limitation attributable to the use of particle acceleration facilities, thus resulting in a difficulty with making autonomous observations.

Furthermore, conventional micro X-ray machines have limitations in terms of application to various imaging apparatuses because the emitted X-ray flux of a tube having 8 micrometer-level resolution at an electron-emission current per unit area of 0.1 mA is insufficient due to the use of a filament-based electron emission source.

Meanwhile, conventional X-ray sources are disadvantageous with its electron beams or X-rays generated in low quality due to disproportionate accelerated electron energy levels, its inability to provide the desired size or electron emission element, and the increase in size of focusing electrodes and gate electrodes due to high early electron emission diffusion.

DISCLOSURE

Technical Problem

An object of the present invention is to provide a digital X-ray source which is capable of adjusting the fixed locations and intervals of electrodes and easily controlling a change in the trajectory of an electron emitted from an emitter by using one or more insulating tubes provided on a cathode electrode inside an X-ray generation unit.

Another object of the present invention is to provide a digital X-ray source in which electric lines are individually insulated from and connected to a focusing electrode, gate electrode and cathode electrode by using one or more insulating tubes and in which high resolution in units of micrometers can be achieved via an emitter capable of achieving electron-emission current per unit area in units of mA.

A further object of the present invention is to provide a digital X-ray source which utilizes a field emission-type X-ray source using nano-material.

Technical Solution

In order to accomplish the above objects, the present invention provides a digital X-ray source including an X-ray generation unit that emits X-rays, wherein the X-ray generation unit includes a cathode electrode; an emitter formed above the cathode electrode; an anode electrode located above the emitter; a gate electrode located between the emitter and the anode electrode; first and second focusing electrodes located between the emitter and the anode electrode; and an electrode connecting unit configured to include one or more insulating tubes capable of fixing and adjusting the locations of the gate electrode and the first and second focusing electrodes on the cathode electrode, and also configured to individually insulate and connect each of the cathode electrode, the gate electrode and the first and second focusing electrodes from and to electric lines.

In order to accomplish the above objects, the electrode connecting unit of the digital X-ray source of the present invention may include a first insulating tube configured to insulate and connect the electric line from and to the cathode electrode; a second insulating tube configured to insulate and connect the electric line from and to the gate electrode; a third insulating tube configured to insulate and connect the electric line from and to the first focusing electrode; and a fourth insulating tube configured to insulate and connect the electric line from and to the second focusing electrode.

In order to accomplish the above objects, the electrode connecting unit of the digital X-ray source of the present invention may be made of a ceramic material.

In order to accomplish the above objects, the emitter of the digital X-ray source of the present invention may be formed by forming an insulating layer on a substrate using a resist patterning method and then arranged inside a gate layer-hole structure by an exposure process.

In order to accomplish the above objects, the gate layer of the digital X-ray source of the present invention may be made of an AlNd metal-based material.

In order to accomplish the above objects, the emitter of the digital X-ray source of the present invention may be formed by growing carbon nano-tubes using a plasma enhanced chemical vapor deposition (PECVD) process.

In order to accomplish the above objects, the emitter of the digital X-ray source of the present invention may have a diameter ranging from 0.1 to 4 mm.

In order to accomplish the above objects, the X-ray generation unit of the digital X-ray source of the present invention may be any one of a single unit X-ray source, a plurality of unit X-ray sources, and a computed tomography scanner.

In order to accomplish the above objects, the gate electrode and first and second focusing electrodes of the digital X-ray source of the present invention may be configured such that the second to fourth insulating tubes pass through the gate electrode and the first and second focusing electrodes.

In order to accomplish the above objects, the emitter of the digital X-ray source of the present invention may have a shape of any one or more of a point light source shape and a surface light source shape.

In order to accomplish the above objects, the one or more insulating tubes of the digital X-ray source of the present invention may be shaped to be hollow, and the electric lines connected to an external power source may be located inside the one or more insulating tubes.

In order to accomplish the above objects, the digital X-ray source of the present invention may control the trajectory of an electron emitted from the emitter by adjusting the fixed locations of the gate electrode and the first and second focusing electrodes using the one or more insulating tubes.

Advantageous Effects

In accordance with the present invention, it is possible to improve the performance of the detection of a micro-tissue, such as a tumor, from among soft tissues having similar densities while significantly reducing radiation dosage to 1/10 of that of computed tomography (CT), so that safe treatment is ensured through a reduction in the amount of exposure to radiation and long-term medical expenses can be reduced through accurate early diagnosis.

Furthermore, airtightness can be achieved by eliminating minute air layers that may be present on interfaces between the electric lines and the one or more insulating tubes, and the size of the X-ray source is reduced and the resolution of acquired images is increased by simplifying the connection of the electrodes inside and outside the X-ray source.

Furthermore, the task of acquiring X-ray images is performed by a digital method including a short On/Off switching operation, so that high-quality images can be acquired through synchronization with a moving organ of the body being examined.

Furthermore, the high-efficient control of electron emission characteristics can be achieved by adjusting the locations of the electrodes via the insulating tubes inside the X-ray generation unit, maintenance costs can be reduced by extending the lifespan of the equipment through the stable emission of electrons, and high resolution and output control can be achieved by making the diameter of an X-ray beam minute.

Furthermore, the X-ray source using a nano-material is utilized, so that the kinetic energy of emitted electrons are almost constant and the directionality of the emission of electrons is desirable, with the result that the size of a focus can be easily controlled via an electrostatic lens or the like, thereby acquiring very clear radiographic images.

Furthermore, the field emission—type X-ray source is utilized, so that the size of an X-ray focus can be precisely adjusted in an electrostatic manner, and errors attributable to a gap around a rotation axis can be reduced, so that blurred boundaries can be extremely reduced, thereby achieving the improvement of the quality of reconstructed images.

BEST MODE

A digital X-ray source according to a preferred embodiment of the present invention will be described with reference to the accompanying drawings.

Figure 1:
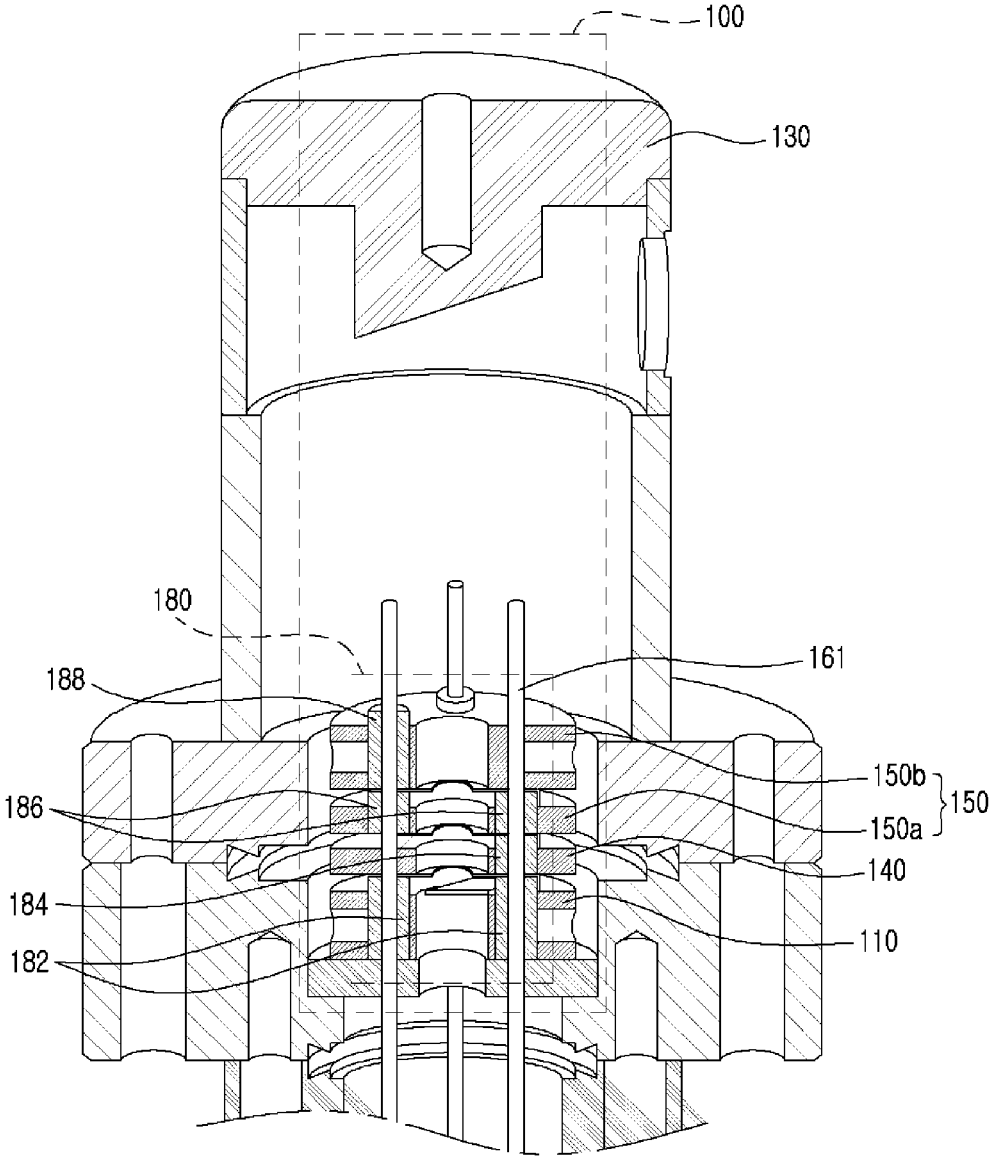
FIG. 1 is a sectional view of a digital X-ray source according to the present invention.

FIG. 1 is a sectional view of a digital X-ray source according to the present invention. The digital X-ray source includes an X-ray generation unit 100, including a cathode electrode 110, an emitter 120, an anode electrode 130, a gate electrode 140, focusing electrodes 150, electric lines 161, and an electrode connecting unit 180. The electrode connecting unit 180 includes first to fourth insulating tubes 182, 184, 186 and 188.

Figure 2:
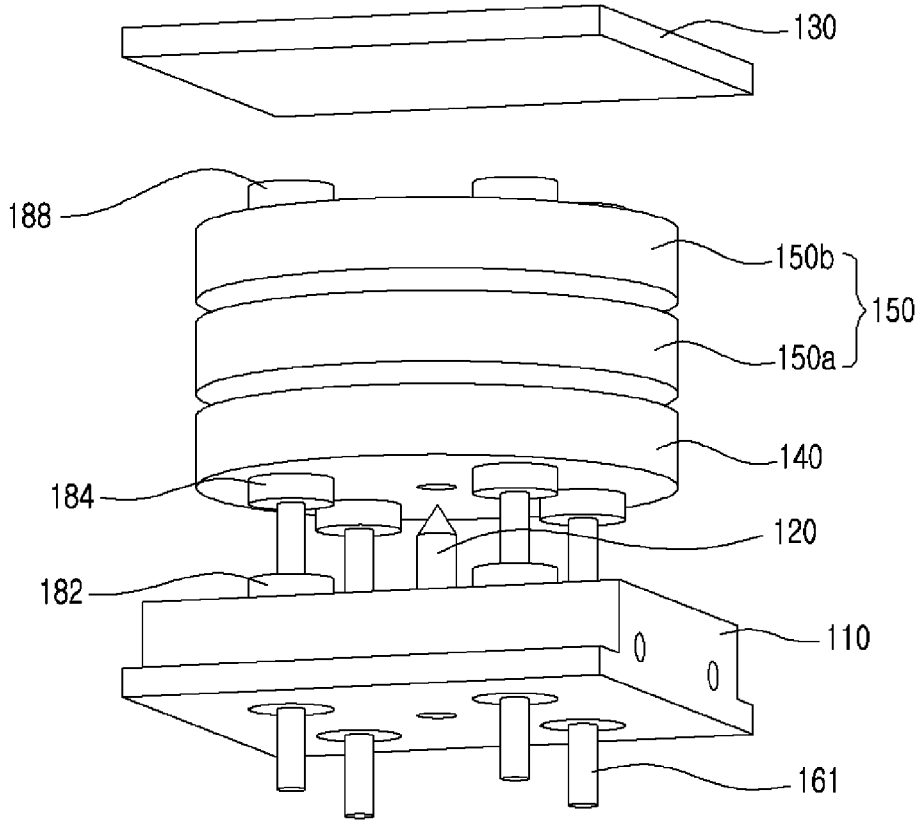
FIG. 2 is a perspective view of the X-ray generation unit 100 inside the digital X-ray source illustrated in FIG. 1 when viewed from below.

FIG. 2 is a perspective view of the X-ray generation unit 100 inside the digital X-ray source illustrated in FIG. 1 when viewed from below. The X-ray generation unit 100 includes the cathode electrode 110, the emitter 120, the anode electrode 130, the gate electrode 140, the focusing electrodes 150, the electric lines 161, and the first to fourth insulating tubes 182, 184, 186 and 188.

Figure 3:
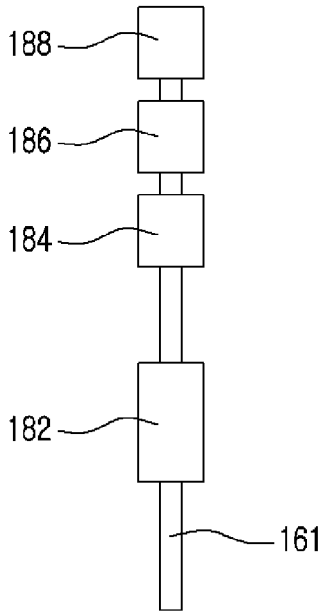
FIG. 3 is a diagram schematically illustrating one or more insulating tubes 182, 184, 186 and 188 used in the digital X-ray source illustrated in FIG. 1.

FIG. 3 is a diagram schematically illustrating one or more insulating tubes 182, 184, 186 and 188 used in the digital X-ray source illustrated in FIG. 1. The electrodes outside and inside a vacuum space are connected to each other through the presence or absence of the first to fourth insulating tubes 182, 184, 186 and 188 themselves.

The functions of the respective components of the digital X-ray source according to the present invention are described with reference to FIGS. 1 to 3, as follows.

In FIG. 2, the third insulating tube 186 is not illustrated because it is located inside the first focusing electrode 150*a* and thus hidden therein.

The X-ray generation unit 100 includes one or more insulating tubes 182, 184, 186 and 188 that adjust the intervals between electrodes, and generates X-rays reflected or passed through the vacuum space by allowing electrons emitted from the emitter 120 to collide with the anode electrode 130 through the accelerated movement of the electrons without scattering.

In this case, the one or more insulating tube 182, 184, 186 and 188 inside the X-ray generation unit 100 are provided above the cathode electrode 110 or are provided to be inserted into the cathode electrode 110 in a vertical direction, and function to separate the above-described gate electrode 140 and the above-described first and second focusing electrodes 150*a* and 150*b* and also function to fix or adjust the locations of the gate electrode 140 and the first and second focusing electrodes 150*a* and 150*b*.

One or more electrode connecting members 170 separately insulates and connects the individual electrodes from and to the electric lines 161 using one or more insulating members instead of volts, i.e., conventional electrode connecting means, and thus eliminate minute air layers that may be present on the interfaces between the individual electrodes and the electric lines 161, thereby maintaining airtightness, increasing the resolution of acquired images, and expecting the long extension of the lifespan of the device.

That is, the first insulating tube 182 insulates and connects one of the electric lines 161 from and to the cathode electrode 110, and the second insulating tube 184 insulates and connects one of the electric lines 161 from and to the gate electrode 140.

Furthermore, the third insulating tube 186 insulates and connects one of the electric lines 161 from and to the first focusing electrode 150*a*, and the fourth insulating tube 188 insulates and connects one of the electric lines 161 from and to the second focusing electrode 150*b*.

In this case, it is preferred that the electrode connecting unit 180 is made of a material, such as a ceramic, thereby enabling the insulation of the electrodes to be maintained and also making the X-ray generation unit small.

The operation of the X-ray generation unit 100 inside the digital X-ray source according to the present invention is described with reference to FIGS. 1 to 3.

The cathode electrode 110 is made of metallic material. The emitter 120 in the form of a point light source and/or a surface light source, which will be described later, is located on the cathode electrode 110.

Furthermore, the cathode electrode 110 is provided with the insulating tube 182 and an electric line to which power is applied, and thus the locations and intervals of the electrodes can be easily controlled by separating or fixing the gate electrode 140 and the focusing electrode 150, which will be described later.

The emitter 120 functions to emit electrons, and is illustrated as having a configuration in the form of a point light source or a surface light source.

The emitter 120 using a carbon nano tube (CNT), ie., a nano material, can emit a high current per unit area, and thus clear radiographic image information can be acquired compared to that in the case of a thermionic electron supply source.

The emitter 120 in the form of a point light source or surface light source is not limited to a specific shape as long as its tip from which electrons are emitted has a pointed shape. However, preferably, the shape thereof may be any one of a conical shape, a tetrahedral shape, a cylindrical shape having a pointed tip, and a polyhedral shape having a pointed tip.

The emitter 120 in the form of a point light source or a surface light source is characterized in that the diameter of the bottom surface thereof is about 0.1 to 6 mm and the height thereof is several nm to several cm. The reason for this is that when these dimensions are ensured, the emitter 120 can effectively discharge electrons as a point light source or a surface light source and can achieve advantages according to the present invention.

That is, if the emitter 120 has a 4 mm-diameter, 1 mA emitter current having a focal size of 1 μm and a current density of 100 $A/cm^2$ can be obtained, which is very advantageous to the early diagnosis of a micro-tissue, such as a tumor, among soft tissues having similar densities.

Furthermore, although the emitter 120 is not limited to a particular type, it is preferably made of a conductive material, including a metal or carbon based material.

Meanwhile, it should be noted that an emitter in the form of a point light source or an emitter in the form of a surface light source may be used as the emitter 120 depending on whether to adjust the trajectory of an emitted electron or depending on desired X-ray source performance. In this case, the emitter in the form of a surface light source is preferably made of a carbon structure or a metal formed on a silicon, metal or carbon-based material.

The anode electrode 130 is located above the emitter 120.

Generally, the anode electrode 130 is preferably made of a material selected from the group consisting of copper, tungsten, manganese, molybdenum and combinations thereof. Furthermore, it should be noted that in the case of a thin film-type X-ray source, the anode electrode 130 may be formed of a metallic thin film Due to this configuration, when the above-described emitter 120 emits electrons, the emitted electrons collide with metal that forms the anode electrode 130, and generate X-rays while being reflected from or passing through the metal.

The gate electrode 140 is located between the emitter 120 and the anode electrode 130. This gate electrode 140 functions to increase the number of electrons emitted from the emitter 120 and further accelerate the speed of emitted electrons.

The first and second focusing electrodes 150*a* and 150*b* are located between the gate electrode 140 and the anode electrode 130. This focusing electrode 150 enables electrons emitted from the emitter 120 to move to the anode electrode 130 without being spread or scattered.

Although the gate electrode 140 is illustrated as being one in number and the first and second focusing electrodes 150*a* and 150*b* are illustrated as being two in number in the drawings, it should be noted that the number and shapes of the gate electrode 140 and the first and second focusing electrodes 150*a* and 150*b* may vary in various manners depending on depending on whether to adjust the trajectory of an emitted electron or depending on desired X-ray source performance.

Furthermore, the gate electrode 140 and the first and second focusing electrodes 150*a* and 150*b* are configured to be detachable from the one or more insulating tubes 182, 184, 186 and 188 and be easily extracted, and are configured to form a plurality of focuses.

Meanwhile, the shapes of the gate electrode 140 and the first and second focusing electrodes 150*a* and 150*b* may be determined depending on the trajectory of electrons emitted from the emitter 120. Although the electrodes are illustrated as being plate-shaped members having a circular hole and a specific thickness in the drawings, it should be noted that the electrodes may be formed in a circular ring shape, a cylinder-like shape having an internal hollow hole, or a plate shape disposed at a specific interval and formed to have a specific thickness.

The principle by which the one or more insulating tubes 184, 186 and 188 control the locations of the gate electrode 140 and the first and second focusing electrodes 150*a* and 150*b* is described more specifically below.

The one or more insulating tubes 184, 186 and 188 are configured to pass through the gate electrode 140 and the first and second focusing electrodes 150*a* and 150*b*. That is, through holes corresponding to the sizes and shapes of the insulating tubes 184, 186 and 188 are formed in the gate electrode 140 and the first and second focusing electrodes 150*a* and 150*b* so that the insulating tubes 184, 186 and 188 can pass through the gate electrode 140 and the first and second focusing electrodes 150*a* and 150*b*.

In this case, although in the past, power coupling members (not illustrated; e.g., specifically-shaped screws or connecting members) have been used to separate the gate electrode 140 and the first and second focusing electrodes 150*a* and 150*b* and maintain them at specific locations, the electrodes are individually insulated from and connected to the electric line 161 via electrode connecting unit 180 in the digital X-ray source according to the present invention.

Referring to FIG. 3, in an embodiment of the present invention, one or more insulating tubes 182, 184, 186 and 188 are formed to be hollow, and the electric lines 161 connected to an external power source are located inside the insulating tubes 182, 184, 186 and 188.

In FIG. 2, although it is preferred that the emitter 120 is located at the center of the cathode electrode 110 and the four electric lines 161 are located to surround the emitter 120, it should be noted that the locations of the four electric lines 161 are not necessarily limited to the above locations.

The insulating tubes of the electrode connecting unit 180 are located outside the respective electric lines connected to an external power source, and the electric lines are connected and fixed by the electrode connecting unit 180, so that appropriate powers can be applied to the respective electrodes.

Figure 4:
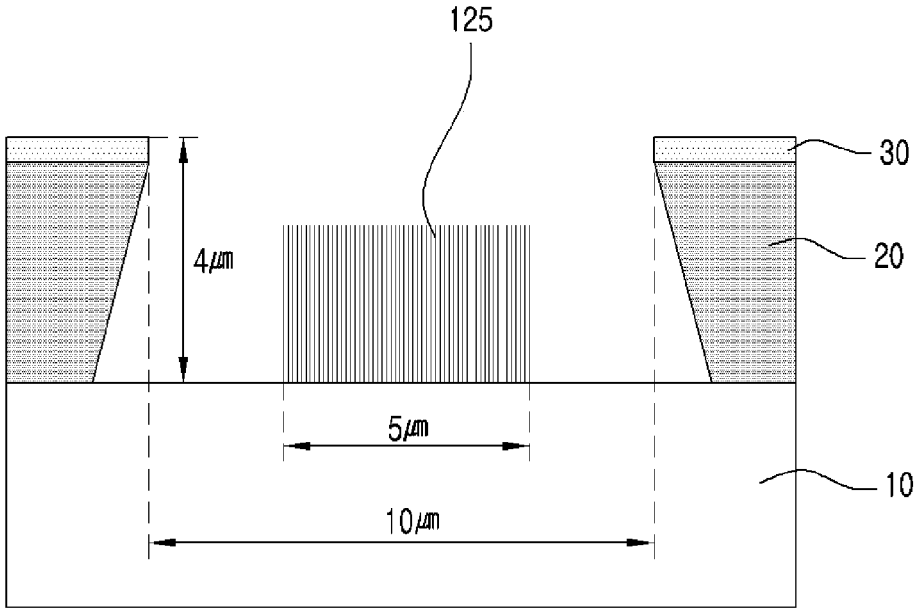
FIG. 4 is a sectional view of the structure of a gate mounting-type emitter inside a digital X-ray source according to the present invention.

FIG. 4 is a sectional view of the structure of a gate mounting-type emitter 120 inside a digital X-ray source according to the present invention. The structure of the gate mounting-type emitter 120 includes a substrate layer 10, an insulating layer 20, a gate metal layer 30, and carbon nano-tubes 125.

Figure 5:
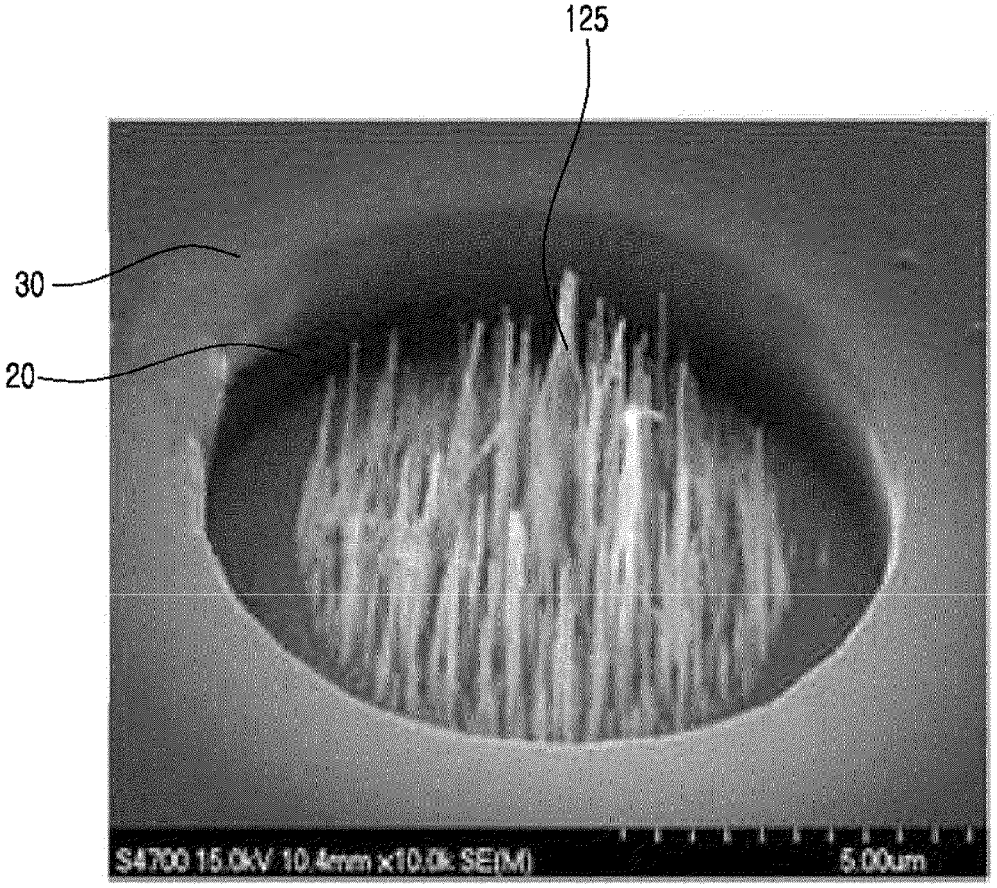
FIG. 5 is a scanning electron microscope (SEM) photo of the structure of the gate mounting-type emitter inside a digital X-ray source according to the present invention.

FIG. 5 is a scanning electron microscope (SEM) photo of the structure of the gate mounting-type emitter inside a digital X-ray source according to the present invention. The structure of the gate mounting-type emitter includes the insulating layer 20, the gate metal layer 30, and the carbon nano-tubes 125.

The structure of the gate mounting-type emitter inside a digital X-ray source according to the present invention is described with reference to FIGS. 1 to 5.

As illustrated in FIG. 4, the insulating layer 20 is formed on the substrate layer 10 using a resist patterning method, and then a gate layer-hole structure is fabricated using an exposure process.

In this case, the 5 μm carbon nano-tubes 125 are arranged inside the 10 μm gate hole. The desired area of the emitter 120 and desired emission current characteristics can be achieved by adjusting the number of structures.

In this case, the resist patterning method is a process of generating a high-output nano electron emission source, and refers to a processing method of forming a substrate at about 600° C. by performing resist coating, patterning and catalytic etching on a substrate layer made of nickel stacked on silicon crystals, and then growing carbon nano-tubes.

Furthermore, the excellent arrangement between the emitter 120 and the gate electrode 140 can be achieved by using an AlNd metal-based material as the gate metal layer 30, and, with regard to the emitter 120, and X-ray tubes having high efficiency and high focusing capability can be fabricated by growing carbon nano-tubes 125 using a PECVD process.

In this case, the PECVD process is a plasma enhanced chemical vapor deposition process. The PECVD process is a kind of chemical vapor deposition (CVD) process that allows a desired material to be deposited on a silicon wafer by reacting gaseous reactants with each other. The PECVD process refers to a process of enabling a chemical reaction at a low temperature by promoting chemical activity by passing a reactant gas through an argon plasma.

As described above, in the digital X-ray source according to the present invention, the one or more insulating tubes are individually insulated from and connected to the focusing electrodes, the gate electrode and the cathode electrode via the electrode connecting unit 180, so that it is possible to improve the performance of the detection of a micro-tissue, such as a tumor, from among soft tissues having similar densities while significantly reducing radiation dosage to 1/10 of that of computed tomography (CT), with the result that safe treatment is ensured through a reduction in the amount of exposure to radiation and long-term medical expenses can be reduced through accurate early diagnosis.

Furthermore, the electrodes are individually insulated from the electric lines via the electrode connecting unit 180, so that the electrodes can be easily connected to the inside and outside of the X-ray source, thereby increasing the completeness of the overall X-ray source and the resolution of acquired images.

Furthermore, high resolution in units of micrometers can be achieved via the emitter capable of achieving electron-emission current per unit area in units of mA, so that the present invention is advantageous to the early diagnosis of a micro-tissue from among soft tissues having similar densities.

Furthermore, the task of acquiring X-ray images is performed by a digital method including a short On/Off switching operation, so that high-quality images can be acquired through synchronization with a moving organ of the body being examined.

Furthermore, the high-efficient control of electron emission characteristics can be achieved by adjusting the fixed locations and intervals of the electrodes via the insulating tubes provided on the cathode electrode inside the X-ray generation unit and easily controlling a change in the trajectory of an electron emitted from the emitter, maintenance costs can be reduced by extending the lifespan of the equipment through the stable emission of electrons, and high resolution and output control can be achieved by making the diameter of an X-ray beam minute.

Furthermore, the field emission—type X-ray source using a nano-material is utilized in the X-ray generation unit, so that the kinetic energy of emitted electrons are almost constant and the directionality of the emission of electrons is desirable, with the result that the size of a focus can be easily controlled via an electrostatic lens or the like, thereby acquiring very clear radiographic images. Also, the size of an X-ray focus can be precisely adjusted in an electrostatic manner, and errors attributable to a gap around a rotation axis can be reduced, so that blurred boundaries can be extremely reduced, thereby achieving the improvement of the quality of reconstructed images.

Although the above description has been given with reference to the preferred embodiment of the present invention, it will be understood by those having ordinary knowledge in the field of art that the present invention can be modified and varied in various manners without departing from the spirit and scope of the present invention described in the attached claims.

The invention claimed is:

1. A digital X-ray source comprising an X-ray generation unit that emits X-rays, wherein the X-ray generation unit comprises:

a cathode electrode;

an emitter formed above the cathode electrode;

an anode electrode located above the emitter;

a gate electrode located between the emitter and the anode electrode;

first and second focusing electrodes located between the emitter and the anode electrode;

at least one first insulating tube tightly fitted into the cathode electrode such that a corresponding electric line passing through the first insulating tube is insulated from the cathode electrode by the first insulating tube;

at least one second insulating tube tightly fitted into the electrode such that a corresponding electric line passing through the second insulating tube is insulated from the gate electrode by the second insulating tube;

at least one third insulating tube tightly fitted into the first focusing electrode such that a corresponding electric line passing through the third insulating tube is insulated from the first focusing electrode by the third insulating tube; and at least one fourth insulating tube tightly fitted into the second focusing electrode such that a corresponding electric line passing through the fourth insulating tube is insulated from the second focusing electrode by the fourth insulating tube.

2. The digital X-ray source of claim 1, wherein each insulating tube is made of a ceramic material.

3. The digital X-ray source of claim 1, wherein the emitter is formed by forming an insulating layer on a substrate using a resist patterning method and then arranged inside a gate layer-hole structure by an exposure process.

4. The digital X-ray source of claim 3, wherein the gate layer is made of an AlNd metal-based material.

5. The digital X-ray source of claim 1, wherein the emitter is formed by growing carbon nano-tubes using a plasma enhanced chemical vapor deposition (PECVD) process.

6. The digital X-ray source of claim 1, wherein the emitter has a diameter ranging from 0.1 to 4 mm.

7. The digital X-ray source of claim 1, wherein the X-ray generation unit is any one of a single unit X-ray source, a plurality of unit X-ray sources, and a computed tomography scanner.

8. The digital X-ray source of claim 1, wherein the emitter has a shape of any one or more of a point light source shape and a surface light source shape.

9. The digital X-ray source of claim 8, wherein a trajectory of an electron emitted from the emitter is controlled by adjusting fixed locations of the gate electrode and the first and second focusing electrodes using the one or more of the first, second, third and fourth.

* * * * *